US006688995B2

(12) United States Patent
Brosens

(10) Patent No.: US 6,688,995 B2
(45) Date of Patent: Feb. 10, 2004

(54) APPARATUS FOR ERECTING AND FIXING A SET OF ELEMENTS FOR THE PRACTICE OF GAMES IN COURTS WITH A NET

(76) Inventor: Pablo Renato Brosens, Avenida Callao 868, 4$^{th}$Apartment "A", (C1023AAO) Buenos Aires (AR)

( * ) Notice: Subject to any disclaimer, the term of this patent is extended or adjusted under 35 U.S.C. 154(b) by 0 days.

(21) Appl. No.: 10/159,254

(22) Filed: May 29, 2002

(65) Prior Publication Data

US 2003/0130075 A1 Jul. 10, 2003

(30) Foreign Application Priority Data

May 30, 2001 (AR) ..... P 01 01 02573

(51) Int. Cl.$^{7}$ ..... A63B 61/04
(52) U.S. Cl. ..... 473/493
(58) Field of Search ..... 473/490, 492, 473/493

(56) References Cited

U.S. PATENT DOCUMENTS 1,459,723 A * 6/1923 Eskell ..... 473/492
1,599,071 A * 9/1926 Warren ..... 473/493
1,641,246 A * 9/1927 Bassford ..... 473/493
3,435,487 A * 4/1969 Mazzei et al. ..... 24/371
3,931,965 A * 1/1976 Grant ..... 473/493
4,040,214 A * 8/1977 Frye ..... 52/157
4,253,671 A * 3/1981 Pace ..... 473/493
4,415,163 A * 11/1983 Schoenig ..... 473/492
4,720,112 A * 1/1988 Stettner et al. ..... 473/492
4,880,243 A * 11/1989 Raub ..... 473/490
5,326,109 A * 7/1994 Robl ..... 473/492
5,542,679 A * 8/1996 Caso ..... 473/175
5,885,176 A * 3/1999 Wong et al. ..... 473/490

* cited by examiner

*Primary Examiner*—Raleigh W. Chiu
(74) *Attorney, Agent, or Firm*—Abelman, Frayne & Schwab

(57) ABSTRACT

An apparatus for erecting and fixing elements for the practice of games in courts with a net suspended and tightened between a pair of poles by guys, and other elements used for establishing the limits and/or predetermined zones. Each one of the poles which fix the net is defined by a bearing tubular assembly comprising, preferably, three sections which are fitted axially together. The tubular assembly has an upper section for holding and fixing the net by ropes, and a lower section which lodges into the ground in a removable way. Sets of anchoring stakes tighten the tubular assembly, having an upper segment fixing guys for tightening the tubular assembly, suspended strings to detect any player who attempts to or does trespass the limits of the forbidden zone of the court, and a lower segment which is also lodged into the ground in a removable way.

7 Claims, 3 Drawing Sheets

APPARATUS FOR ERECTING AND FIXING A SET OF ELEMENTS FOR THE PRACTICE OF GAMES IN COURTS WITH A NET

BACKGROUND OF THE INVENTION

1. Field of the Invention

The following invention refers to an apparatus for erecting and fixing a set of elements for the practice of games, such as tennis, paddle, volleyball, badminton, and other similar sports in courts with a net, and more particularly the invention deals with an apparatus preferably applicable to the erection and fixing of, for example, a net, guys, and ropes used for practicing games such as tennis, paddle, volleyball, badminton, and other similar sports.

2. Description of the Related Art

The state of the art proves that no other devices which are known of may be compared with the apparatus described in this invention. However, a brief description is given next on the way nets are usually mounted on courts for playing tennis, paddle, volleyball, badminton, and other similar sports, for the purpose of showing the fundamental concepts which allow one to better appreciate the novelty and merit of this invention.

Indeed, anybody may notice the way in which tennis and paddle courts are set up, either for professional or amateur use, in various locations on a beach, on club grounds, or on private residences and/or gardens, and on all types of surfaces including natural and/or synthetic grass, cement, etc. In any of such cases, the net spreads between two posts standing on both sides of the court and is tied to them and tightened by ropes and tensioning devices. In courts used for professional tournaments, as well as those built on club grounds or public recreational areas, the posts may be made out of hard wood, metal, and/or any other resistant and/or rigid material, and are usually permanently imbedded in the ground. So, such courts and sports fields always keep the characteristics which are required for practicing the same game, even when the net has been removed. In other words, the posts which hold the tensioning devices, as well as the other elements which are used to bound the court, stand permanently in place.

Whereas the aforementioned system is convenient for such permanent lay-outs, it is certainly not so convenient when practicing sports on the beach, in gardens, or in residential parks. Indeed in such cases, the practice of sports, such as tennis, is mostly occasional; that is, there frequently is no exclusive area for such sports practice, nor are there strong posts or tensioning devices readily available, nor are the elements required for if a establishing the boundaries of the court readily available.

Moreover, when one wishes to practice such sports in residential areas not exclusively reserved for such use or purposes, the installation of permanent poles undoubtedly is a nuisance to the general appearance of the site, which is not desirable, and it may also hinder the daily usage of these areas.

BRIEF SUMMARY OF THE INVENTION

The invention, which is explained further herein, is a solution to these inconveniences, which not only provides an effective apparatus for mounting and fixing the elements which are required for practicing the mentioned example court-based games, but also may be applied to new sports which are variations of the traditional ones and for which, at the present time, there are no appropriate installations.

Indeed, the proposed solution allows for the practice of both traditional sports such as tennis, volleyball, badminton, paddle, deck-tennis, or eventually any combination of any of these games which results in a new form of entertainment, physical exercise, and even sports competitions in the most varied places.

Therefore, the purpose of the present invention is to provide an apparatus for erecting and fixing a set of elements for the practice of games in courts with a net, preferably applicable to erecting and fixing, for example, a net suspended between end poles and tightened by the use of guys, and other elements which are used to determine the boundaries and/or special areas for practicing games such as tennis, paddle, volleyball, badminton, and other similar sports, in which each one of the poles which holds the net is a bearing tubular assembly composed of at least one section. This bearing tubular assembly includes an upper part for fastening and lateral tensioning the net by the use of guys, and a lower part which may be removed from the ground. Furthermore, the apparatus includes a set of stakes for anchoring the poles, each one of which include an upper segment for hooking the guys which tighten the poles, and a lower segment which may also be removed from the ground. Furthermore, the apparatus includes tubular sockets built into the ground, which provide anchoring for the lower portion of the net poles and of each one of the stakes. It is to be noted that these anchoring tubular sockets pipes may not be necessary, and so are optional, when the court is built on sand.

The following invention refers to an apparatus for erecting and fixing a set of elements for the practice of games in courts with a net, and more particularly deals with an apparatus preferably applicable to the erection and fixing of, for example, a net, guys, and ropes used for practicing games such as tennis and other similar sports. However, the apparatus of the present invention may also be applied to erect the elements which are needed for playing other games or sports such as volleyball, badminton, paddle, and the ancient deck-tennis. The disclosed apparatus may be used, as described herein, either outdoors or indoors and on wooden surfaces as well as on cement, sand, and/or grass, just to mention the most usual cases.

An apparatus is also disclosed for erecting and fixing a set of elements for the practice of games in courts with a net, preferably applicable to the erection and fixing of, for example, a net suspended and tightened between a pair of poles by the use of guys, and other elements used for establishing the limits and/or predetermined zones for practicing games such as tennis, paddle, badminton and similar sports. Each one of the poles which fixes the net is defined by a bearing tubular assembly including, preferably, three sections which are fitted axially together. The tubular assembly has an upper section for holding and fixing the net using ropes, and a lower section which lodges into the ground in a removable way.

The apparatus includes sets of anchoring stakes for tightening the tubular assembly, which have an upper segment which fixes guys for tightening the tubular assembly, and suspended strings which detect any player who attempts to or does trespass the limits of the forbidden zone of the court; and a lower segment which is also lodged into the ground in a removable way. The lower sections of the tubular assemblies which support the net and the lower segments of the anchoring stakes which tighten the tubular assemblies are respectively lodged in pipes imbedded in the ground, which define anchoring sockets for the lower sections of the tubular assemblies and for the lower segments of the anchoring stakes.

BRIEF DESCRIPTION OF THE SEVERAL VIEWS OF THE DRAWINGS

For the sake of clearness and better understanding of the purpose of the present invention, this description includes several drawings showing its preferred forms of execution which are used as examples, where.

DETAILED DESCRIPTION OF THE INVENTION

Figure 1:
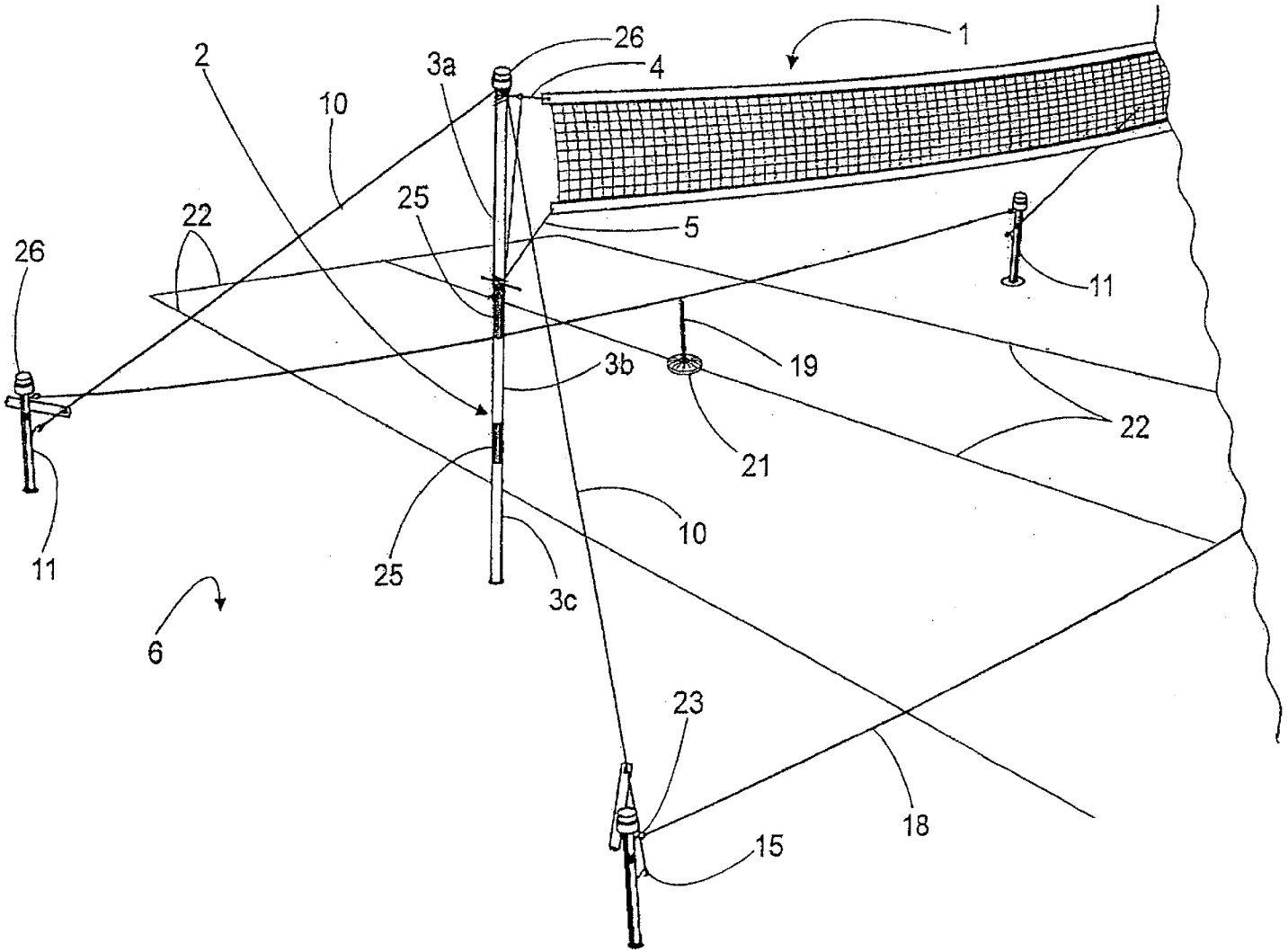
FIG. 1 is a partial perspective view of a sports court which shows the apparatus included in the subject matter of this invention.

Referring to FIG. 1, a sports court is illustrated for use with the apparatus included in the subject matter of this invention. The net 1 of this court is suspended at one of its ends, and at a pre-established height, using a pole made of a tubular assembly 2. FIG. 1 shows the elements associated with only one of the ends of net 1, and it is to be kept in mind that, at the other end of the net 1, there is another set of elements similar and/or identical to those elements shown in FIG. 1.

Each one of the poles which support the net 1 is made of a tubular assembly which includes at least one section. Usually this tubular assembly 2 may be made of two section, or preferably three sections which are fitted axially together by couplings 25. Indeed, FIG. 1 shows a preferred execution of the tubular assembly 2 which is made of three sections: an upper section 3*a* which holds and fixes the net 1 by the use of the ropes 4, 5, a middle section 3*b*, and a lower section 3*c* which lodges in a removable way into the ground 6.

Figure 2:
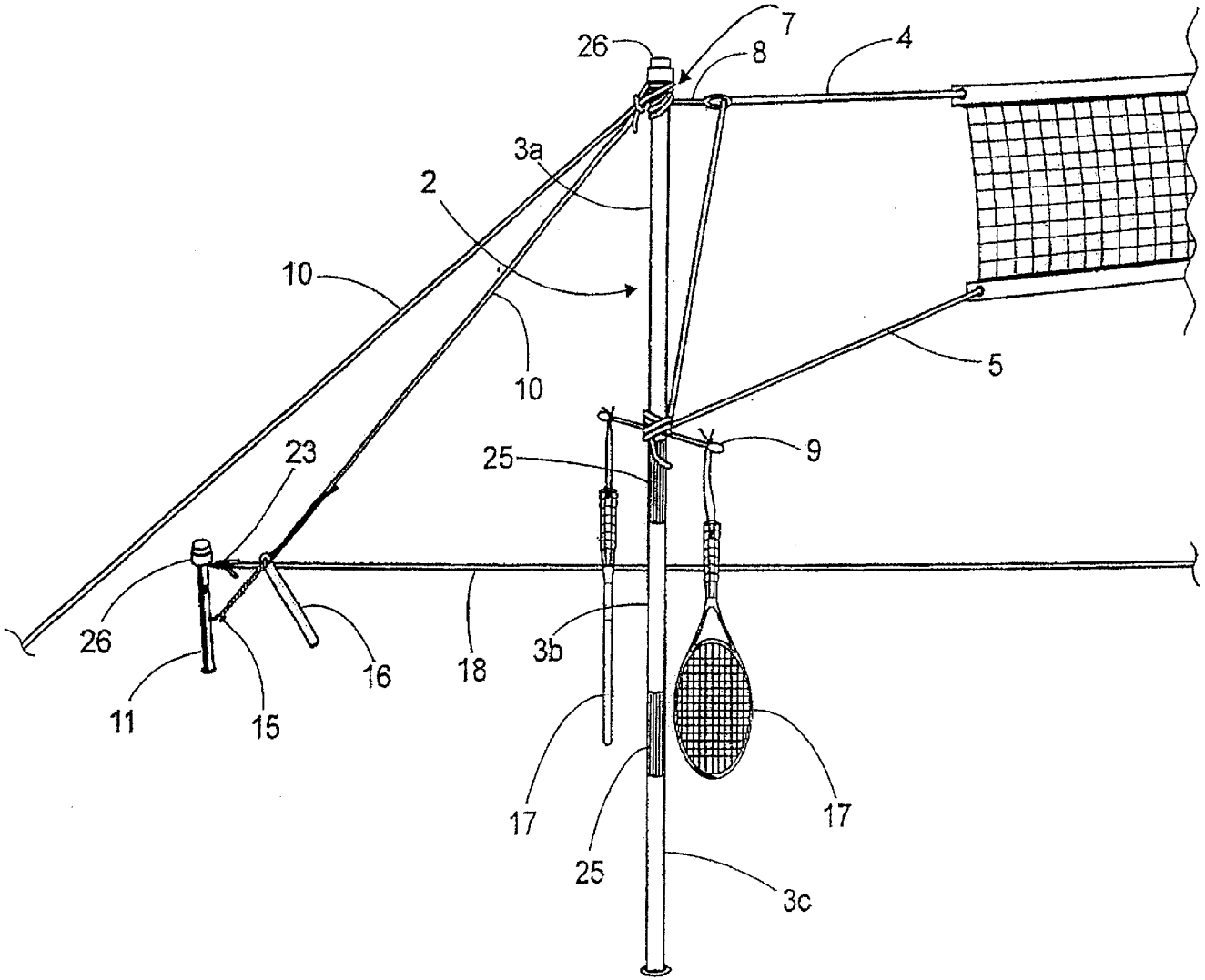
FIG. 2 is a partial perspective view which shows one of the poles which holds the net of the court in FIG. 1, one of the stakes being used for anchoring these poles, ropes, and other elements which is described further herein.

As clearly shown in FIG. 2, the upper section 3*a* of the tubular assembly 2 has an eye-bolt 8 and a cross-piece 9 which together allow for the easy and quick fastening of the ropes 4, 5 which tension the net 1. Moreover, the eye-bolt 8 provides a bearing point 7 for one end of the guys 10 which are used to tighten the tubular assembly 2. The other end of the guys 10 is fixed to one of the stakes 11 which anchors and stabilizes the tubular assembly 2. It is to be noted, moreover, that the ends of the cross-pieces 9 may be used as hangers for paddles 17, rackets, ball or badminton bird holders, and/or other sports equipment, as shown in FIG. 2.

Figure 3:
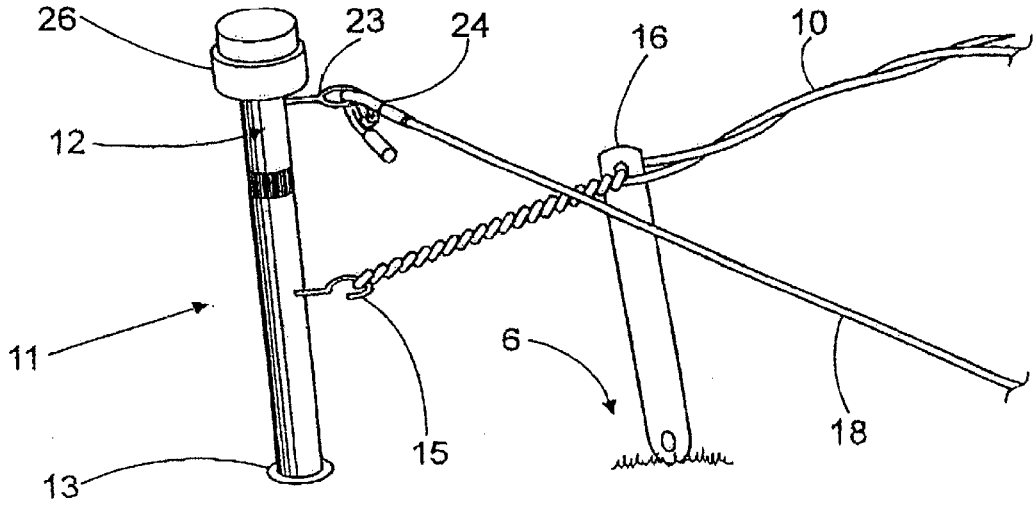
FIG. 3 is a perspective view which shows one of the anchoring stakes and the ropes associated with such stakes, as well as other components which are described further herein.
Figure 4:
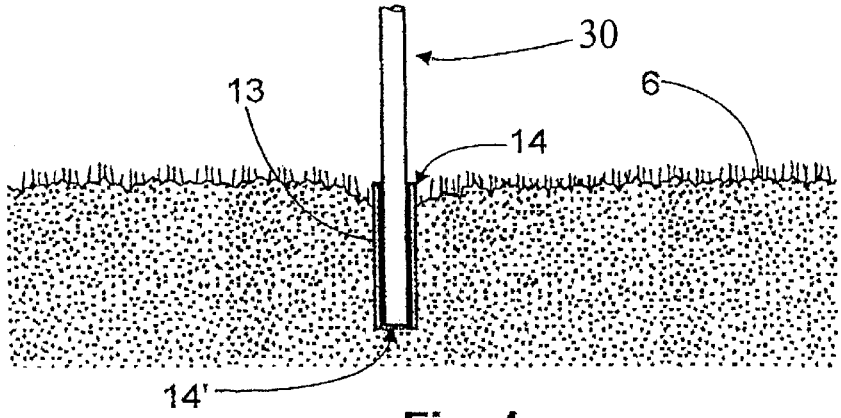
FIG. 4 is a cross-sectional and elevational view which illustrates the way that the net poles and the stakes are lodged into the ground.

FIG. 3 shows a detail of the stakes 11 where it may be seen that the upper segment or portion 12 of these stakes stands out of the ground and fixes one guy 10 which tensions the tubular assembly 2; whereas their lower segment 14, not shown in FIG. 3 but shown in FIG. 4, is lodged in a removable way into a pipe 13 imbedded in the ground 6.

The lower end of each tubular assembly 2 may also be lodged into another pipe 13 imbedded in the ground 6. The upper and lower ends 14 of these pipes 13 are open, so which the pipes 13 provide anchoring sockets for the lower segments of the tubular assemblies 2 and of the stakes 11. This may be clearly seen in the cross-sectional view of FIG. 4, which shows one such pipe 13 which lodges either the lower section of any one of the tubular assemblies 2, or the lower end of any one of the stakes 11, with either of the tubular assemblies 2 or the stakes 11 represented in FIG. 4 as the longitudinally extending element 30, which may be cylindrical and/or a parallelepiped which may be removably lodged inside the pipe 13.

It is to be noted that the upper rims 14 of the pipes 13 may be level with the ground surface 6. This is an advantage since the pipes 13 may present no obstacles to grass-mowing if, for example, it is a grass-court, or no obstacles to cleaning and/or maintenance in case the court surface is wood, cement, etc.

Figure 5:
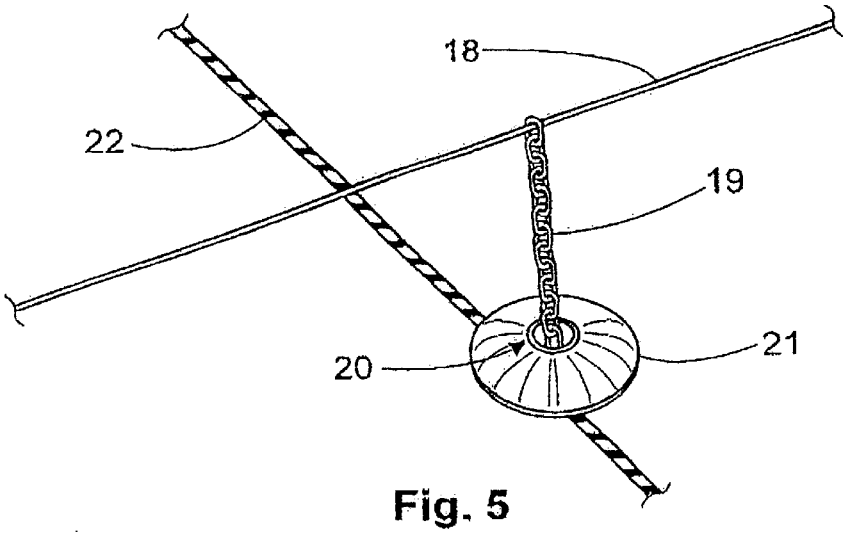
FIG. 5 is a perspective view which shows one of the devices used to detect the intrusion of one of the players into one of the prohibited zones of the court, with the devices being accessories of the apparatus included in the subject matter of the present invention.

Once the apparatus included in the subject matter of this invention has been removed from the court, the area recovers its original appearance because the pipes 13, being imbedded in the ground, may not be seen, and also because the guys 10 and any court boundaries 22, for example, ropes; white, colored, or alternating colored strips; etc., shown in FIGS. 1 and 5, may be removed.

Furthermore, the circular openings of the pipes 13 may be covered by caps in order to avoid the entrance of rubbish or other extraneous material which might preclude the proper installation of the tubular assemblies 2 and/or the stakes 11.

The tips of tubular assemblies 2 as well as those of the stakes 11 may be covered with removable caps 26, the dimensions of which also make them appropriate to cover the rims or circular openings 14 of the pipes 13, so that the caps 26, once fitted over the ends of the pipes 13, may be flush with the ground surface 6.

Going back to FIG. 3 in conjunction with FIGS. 1–2, the upper portion 12 of the stake 11 has a hook-bolt 15 which fastens one guy 10 for tensioning the corresponding tubular assembly 2. The open portion of the hook of the bolt 15 makes it easier to hook or unhook an end loop of the guy 10. One of the branches of this loop goes through a hole located at the end of a lever-like metal plate 16. By twisting plate 16 around the end loop of guy 10, one obtains a tourniquet-like action for the purpose of gradually tensioning guy 10 and net 1. Once any of the plates 16 associated with respective guys 10 have been twisted as many times as necessary to achieve a desired tension, the free ends of the plates 16 may be locked or otherwise secured from movement by friction either against the ground surface 6 or against the upper portion 12 of the stakes 11, thereby keeping the required tension on guys 10. By tensioning any or all of the guys 10, it is possible to gradually lift the net 1 until the net 1 reaches the required or a desired height.

As shown in FIG. 1 and in the more detailed views in FIGS. 3 and 5, the apparatus also includes means for detecting players who trespass the limits of the forbidden zones of the court during a rally. These detection means includes suspended strings 18 which run between pairs of stakes 11 on both sides of the net 1. Both ends of each suspended string 18 are fixed to bolts 23 placed near the tip of each stake 11. Both ends of the string 18 may be hooked using clips or adjustable knots or loops. Alternatively, whereas one end of string 18 may hooked to an eye-bolt 23 by the use of a clip 24, the other end of string 18 may be hooked to another bolt 23 of the type open-hook type by the use of an adjustable lasso loop.

A chain 19, which may be relatively short, hangs from each one of the strings 18. The free end of this chain 19 is fed into a pipe 20 analogous to the pipes 13, which have been previously described, and similarly imbedded into the ground 6. A disk-shaped flange 21 surrounds the upper orifice of the pipe 20.

If the suspended string 18 is pushed sideways by one of the players, the free end of the chains 19 is completely removed out of the pipe 20, in which case this puts in evidence the fault or trespassing which has been committed. The disk-shaped flange 21 allows for a better visualization of the chain 19 exiting the inside of the pipe 20. In this manner, the suspended string 18, the chain 19, and the pipe 20 constitute a device for detecting trespassings.

The boundaries 22, for example, ropes, which are used to bound the limits of the court and which are also shown in FIG. 1, may be fixed to the ground 6 in a removable way by the use of, for instance, "U"-shaped hooks nailed into the ground 6 in inverted position.

It is to be noted that the bolts 15, 23 protrude from the stakes 11 in such a way to optionally be used jointly for winding up one string 18 into a hank when the apparatus is dismounted or disassembled.

Likewise, the eye-bolt 8 and the cross-piece 9 on the upper sections 3*a* of the tubular assemblies 2 may be used jointly for winding up into hanks all the ropes which bound the court as boundaries 22, so that reels for winding and storing the ropes are not needed.

In one embodiment, all of the stakes 11 and each one of the sections which constitute the tubular assembly 2 may have preferably the same length, so that all of these elements 2, 11 as well as the ropes used as the boundaries 22, in addition to the guys 10, the strings 18, the net 1, and the paddles 17, may fit into one single conventional bag such as an equipment bag and/or a duffel bag, making it relatively easy to carry all the components of the apparatus which is included in the subject matter of this invention.

Having thus particularly described the present invention and determined its nature, as well as the manner it may be put into practice, the following asserted claims are declared to be of exclusive property and right.

What is claimed is:

1. An apparatus for erecting and fixing a set of elements for the practice of games in courts with a net suspended and tightened between a pair of poles by guys, and with limiting elements for establishing the limits and/or predetermined zones for practicing the games, the apparatus comprising:

a bearing tubular assembly associated the poles and including at least one section;

an upper portion for fixing and lateral tensioning of the net using the guys;

a lower portion removably lodged into the ground; and sets of stakes for anchoring the tubular assembly, the stakes having:

an upper segment for fixing the guys which tighten the tubular assembly;

a lower segment removably lodged into the ground; and pipes imbedded in the ground, each one of which defines an anchoring socket for the respective lower sections of the tubular assemblies which support the net and for the respective lower segments of the stakes which serve as anchors for tightening the tubular assemblies;

wherein the end-loop of each one of the guys which tighten the tubular assemblies is threaded into a hole drilled on one end of a lever-like metal plate placed near the corresponding anchoring stake, so which the metal plate constitutes a revolving tourniquet for tensioning the aforementioned guy.

2. An apparatus for erecting and fixing a set of elements for the practice of games in courts with a net suspended and tightened between a pair of poles by guys, and with limiting elements for establishing the limits and/or predetermined zones for practicing the games, the apparatus comprising:

a bearing tubular assembly associated the poles and including:

at least one section;

an upper portion for fixing and lateral tensioning of the net using the guys;

a lower portion removably lodged into the ground; and sets of stakes for anchoring the tubular assembly, the stakes having:

an upper segment for fixing the guys which tighten the tubular assembly;

a lower segment removably lodged into the ground; and pipes imbedded in the ground, each one of which defines an anchoring socket for the respective lower sections of the tubular assemblies which support the net and for the respective lower segments of the stakes which serve as anchors for tightening the tubular assemblies;

means for detecting players who trespass the limit of the forbidden zone of the court during a rally, with the forbidden zone and the detection means defined by a string which runs parallel to the net, suspended between a pair of stakes, and having a fault detector at mid-span, which is linked to a pipe imbedded into the ground and having its upper rim flush with the adjacent surface.

3. An apparatus for erecting and fixing a set of elements for the practice of games in courts with a net suspended and tightened between a pair of poles by guys, and with limiting elements for establishing the limits and/or predetermined zones for practicing the games, the apparatus comprising:

a bearing tubular assembly associated the poles and including:

at least one section;

an upper portion for fixing and lateral tensioning of the net using the guys;

a lower portion removably lodged into the ground; and sets of stakes for anchoring the tubular assembly, the stakes having;

an upper segment for fixing the guys which tighten the tubular assembly;

a lower segment removably lodged into the ground; and pipes imbedded in the ground, each one of which defines an anchoring socket for the respective lower sections of the tubular assemblies which support the net and for the respective lower segments of the stakes which serve as anchors for tightening the tubular assemblies; and means for detecting players who trespass the limit of the forbidden zone of the court during a rally, with the detection means defined by a string which runs parallel to the net, suspended between a pair of stakes, and having a fault detector at mid-span, which is linked to a pipe imbedded into the ground and having its upper rim flush with the adjacent surface;

wherein the fault detector is defined by a tiny chain which hangs from the corresponding suspended string, with its free end fed into the pipe, so which it is able to completely come out of this pipe if the string is pushed sideways.

4. An apparatus for erecting and fixing a set of elements for the practice of games in courts with a net suspended and tightened between a pair of poles by guys, and with limiting elements for establishing the limits and/or predetermined zones for practicing the games, the apparatus comprising:

a bearing tubular assembly associated the poles and including:

at least one section;

an upper portion for fixing and lateral tensioning of the net using the guys;

a lower portion removably lodged into the ground; and sets of stakes for anchoring the tubular assembly, the stakes having:

an upper segment for fixing the guys which tighten the tubular assembly;

a lower segment removably lodged into the ground; and pipes imbedded in the ground, each one of which defines an anchoring socket for the respective lower sections of the tubular assemblies which support the net and for the respective lower segments of the stakes which serve as anchors for tightening the tubular assemblies;

wherein the upper section of each one of the tubular assemblies which support the net has an upper eye-bolt and a lower cross-piece for fastening the ropes which hold the net;

wherein the upper eye-bolt provides a bearing point for one end of the guys which connect the respective tubular assembly to its anchoring stakes; and wherein the upper eye-bolt and lower cross-piece together make up a means used for winding up ropes into a hank.

5. An apparatus for erecting and fixing a set of elements for the practice of games in courts with a net suspended and tightened between a pair of poles by guys, and with limiting elements for establishing the limits and/or predetermined zones for practicing the games, the apparatus comprising:

a bearing tubular assembly associated the poles and including:

at least one section;

an upper portion for fixing and lateral tensioning of the net using the guys;

a lower portion removably lodged into the ground; and sets of stakes for anchoring the tubular assembly, the stakes having:

an upper segment for fixing the guys which tighten the tubular assembly;

a lower segment removably lodged into the ground; and pipes imbedded in the ground, each one of which defines an anchoring socket for the respective lower sections of the tubular assemblies which support the net and for the respective lower segments of the stakes which serve as anchors for tightening the tubular assemblies;

wherein the upper segment of each one of the anchoring stakes has a hook-bolt, the purpose of which is to anchor one end-loop of the corresponding guy which tightens the tubular assembly supporting the net; and wherein each one of the anchoring stakes has an upper bolt which in conjunction with the anchoring hook-bolt, is used for winding up strings into a hank.

6. An apparatus for erecting and fixing a set of elements for the practice of games in courts with a net suspended and tightened between a pair of poles by guys, and with limiting elements for establishing the limits and/or predetermined zones for practicing the games, the apparatus comprising:

a bearing tubular assembly associated the poles and including:

at least one section;

an upper portion for fixing and lateral tensioning of the net guys; using the a lower portion removably lodged into the ground; and sets of stakes for anchoring the tubular assembly, the stakes having:

an upper segment for fixing the guys which tighten the tubular assembly;

a lower segment removably lodged into the ground; and pipes imbedded in the ground, each one of which defines an anchoring socket for the respective lower sections of the tubular assemblies which support the net and for the respective lower segments of the stakes which serve as anchors for tightening the tubular assemblies;

wherein the upper section of each one of the tubular assemblies which support the net has an upper eye-bolt and a lower cross-piece for fastening the ropes which hold the net;

wherein the upper eye-bolt provides a bearing point for one end of the guys which connect the respective tubular assembly to its anchoring stakes; and wherein the end-loop of each one of the guys which tighten the tubular assemblies is threaded into a hole drilled on one end of a lever-like metal plate placed near the corresponding anchoring stake, so which the metal plate constitutes a revolving tourniquet for tensioning the aforementioned guy.

7. An apparatus for erecting and fixing a set of elements for the practice of games in courts with a net suspended and tightened between a pair of poles by guys, and with limiting elements for establishing the limits and/or predetermined zones for practicing the games, the apparatus comprising:

a bearing tubular assembly associated the poles and including:

at least one section;

an upper portion for fixing and lateral tensioning of the net using the guys;

a lower portion removably lodged into the ground; and sets of stakes for anchoring the tubular assembly, the stakes having:

an upper segment for fixing the guys which tighten the tubular assembly;

a lower segment removably lodged into the ground; and pipes imbedded in the ground, each one of which defines an anchoring socket for the respective lower sections of the tubular assemblies which support the net and for the respective lower segments of the stakes which serve as anchors for tightening the tubular assemblies;

wherein the upper segment of each one of the anchoring stakes has a hook-bolt, the purpose of which is to anchor one-loop of the corresponding guy which tightens the tubular assembly supporting the net; and wherein the end-loop of each one of the guys which tighten the tubular assemblies is threaded into a hole drilled on one end of a lever-like metal plate placed near the corresponding anchoring stake, so which the metal plate constitutes a revolving tourniquet for tensioning the aforementioned guy.

* * * * *